United States Patent [19]

Colley

[11] 4,441,323

[45] Apr. 10, 1984

[54] COMBUSTION EQUIPMENT FOR A GAS TURBINE ENGINE INCLUDING A FUEL BURNER CAPABLE OF ACCURATE POSITIONING AND INSTALLATION AS A UNIT IN A FLAME TUBE

[75] Inventor: Rowan H. Colley, Sunnyhill, England

[73] Assignee: Rolls-Royce Limited, London, England

[21] Appl. No.: 354,047

[22] Filed: Mar. 2, 1982

[30] Foreign Application Priority Data

Apr. 16, 1981 [GB] United Kingdom ..... 8112098

[51] Int. Cl.[3] ..... F02C 7/22

[52] U.S. Cl. ..... 60/737; 60/748; 60/39.32

[58] Field of Search ..... 60/39.31, 39.32, 734, 60/737, 738, 740, 742, 748, 750, 751; 239/405, 406, 587, 600

[56] References Cited

U.S. PATENT DOCUMENTS

| | | | |
|---|---|---|---|
| 2,720,080 | 10/1955 | Oulianoff et al. | 60/751 |
| 3,703,259 | 11/1972 | Sturgess et al. | 60/742 |
| 3,879,940 | 4/1975 | Stenger et al. | 60/737 |
| 4,189,913 | 2/1980 | Carlisle | 60/740 |
| 4,216,652 | 8/1980 | Herman et al. | 239/406 |
| 4,271,675 | 6/1981 | Jones et al. | 239/406 |

FOREIGN PATENT DOCUMENTS

| | | | |
|---|---|---|---|
| 819141 | 8/1959 | United Kingdom | 60/39.32 |
| 1148985 | 4/1969 | United Kingdom . | |
| 1284439 | 8/1972 | United Kingdom . | |
| 1429589 | 3/1976 | United Kingdom . | |
| 1547770 | 6/1979 | United Kingdom . | |
| 1563125 | 3/1980 | United Kingdom . | |

*Primary Examiner*—Louis J. Casaregola
*Assistant Examiner*—Timothy S. Thorpe
*Attorney, Agent, or Firm*—Cushman, Darby & Cushman

[57] ABSTRACT

The invention relates to fuel burners and to combustion equipment for use in gas turbine engines.

A more uniform mixture of fuel and air can be obtained in an annular flame tube by ensuring that each fuel injector is maintained in a fixed position in relationship to the annular flame tube. The present invention provides a fuel burner and combustion equipment with means to locate the fuel injector in a fixed position in relationship to the annular flame tube.

The fuel burner comprises a fuel feed arm and a fuel injector. The fuel injector is attached to the fuel feed arm, and a fuel passage extends coaxially through the fuel feed arm and supplies fuel to the fuel injector. The fuel from the fuel passage is supplied to a fuel chamber in a pintle positioned within a duct in the fuel injector. The fuel chamber supplies the fuel through a number of fuel passages into the duct. The annular flame tube has a plurality of apertures in the head, and a swirler assembly is positioned coaxially within each aperture, and a fuel injector is positioned coaxially in each of the swirler assemblies. A tongue extends from and is substantially perpendicular to the axis of the fuel injector and the tongue engages with an upstream extending projection of the swirler assembly, to locate the fuel injector relative to the flame tube.

5 Claims, 7 Drawing Figures

Figure 1:
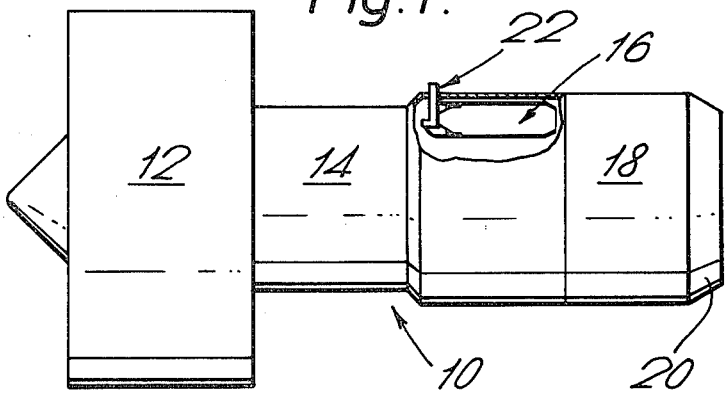

A
B
C
112
72
70
108
110
106
102
104
116
56
50
114
96
58
68
16
100
94
98
54
24
28
52
60
26
64
66
34
32
40
22
44
82
42
86
76
37
80
90
88
78
62
93
84
47
38
46
36
48
92
74
30

COMBUSTION EQUIPMENT FOR A GAS TURBINE ENGINE INCLUDING A FUEL BURNER CAPABLE OF ACCURATE POSITIONING AND INSTALLATION AS A UNIT IN A FLAME TUBE

This invention relates to fuel burners and the combination of fuel burners and annular combustion equipment for use in gas turbine engines.

It is necessary that fuel and air are thoroughly mixed in gas turbine flame tubes, and a number of methods are available to achieve such mixing.

A more uniform mixture of fuel and air in an annular flame tube can be obtained by ensuring that the axis of the fuel injector is maintained in a fixed position in relationship to the annular flame tube, irrespective of thermal expansions or distortions of the annular flame tube.

The present invention seeks to provide a fuel burner and combustion equipment with means to locate the fuel injector in a fixed position in relationship to the annular flame tube.

A more uniform mixing of fuel and air throughout the annular flame tube used in annular combustion equipment can also be obtained by using larger numbers of fuel burners for a given annular flame tube.

Fuel burners tend to be large and bulky and require relatively large access holes in the engine casing, and these holes create stress concentrations.

The use of larger numbers of fuel burners creates several disadvantages, such as the weight of the engine is increased, and the stress in the engine casing is increased because of the increase in the numbers of holes in the casing.

The present invention also seeks to provide a fuel burner that requires a relatively smaller access hole in the casing. The advantages resulting from such a fuel burner are that, a reduction in weight of the engine could be achieved and a reduction in the stress concentrations in the engine casing could be obtained.

Accordingly the present invention provides a gas turbine engine fuel burner comprising a fuel feed arm and a fuel injector, the fuel feed arm and the fuel injector being joined together, the fuel feed arm having at least one fuel passage, the fuel injector comprising a body having a passage in communication with the at least one fuel passage in the fuel feed arm, the body having an air duct, the axis of the air duct being coaxial with the axis of the fuel injector, the fuel injector having one or more fuel passages to inject fuel into the air duct, the fuel burner having locating means at the end adjacent the fuel injector, the locating means being arranged to engage with corresponding locating means on an engine component.

The present invention also provides combustion equipment for a gas turbine engine comprising an engine casing, at least one flame tube and a plurality of fuel burners, the engine casing having a circumferential arrangement of holes, the at least one flame tube having an upstream end and a head, the at least one flame tube having at least one aperture in the upstream end and at least one aperture in the head, a swirler assembly being positioned coaxially in each aperture in the head, the at least one flame tube having means to locate the fuel burners, each fuel burner comprising a fuel feed arm and a fuel injector, the fuel feed arm and the fuel injector being joined together, the fuel feed arm having at least one fuel passage, the fuel injector comprising a body having a passage in communication with the at least one fuel passage in the fuel feed arm, the body having an air duct, the axis of the air duct being coaxial with the axis of the fuel injector, the fuel injector having one or more fuel passages to inject fuel into the air duct, the fuel burner having locating means at the end adjacent the fuel injector, the locating means being arranged to engage with the corresponding locating means on the at least one flame tube, each fuel feed arm extending coaxially through the hole in the engine casing into the aperture in the upstream end of the at least one flame tube, and the fuel injector extending coaxially in the aperture in the head.

Figure 3:
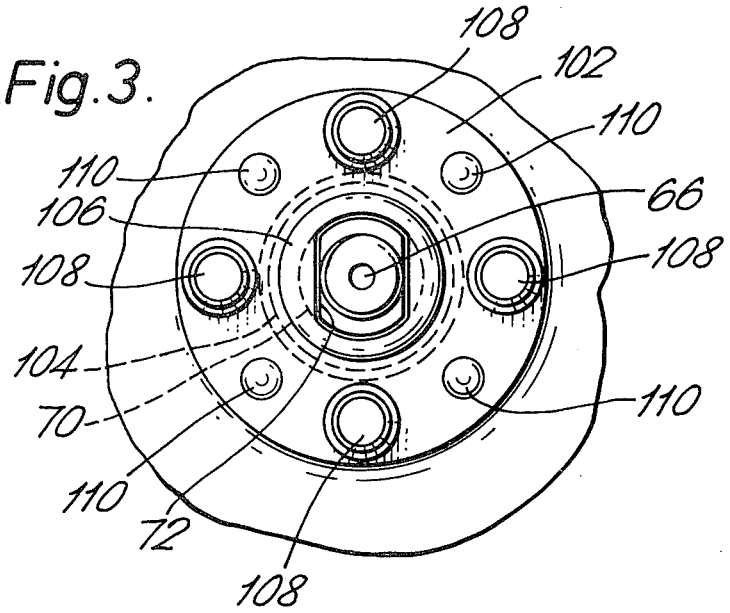
Figure 4:
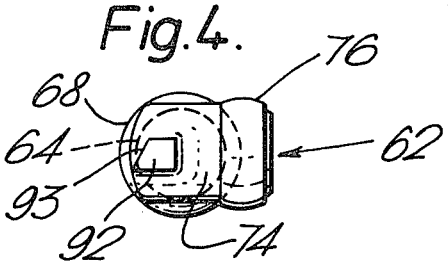
Figure 2:
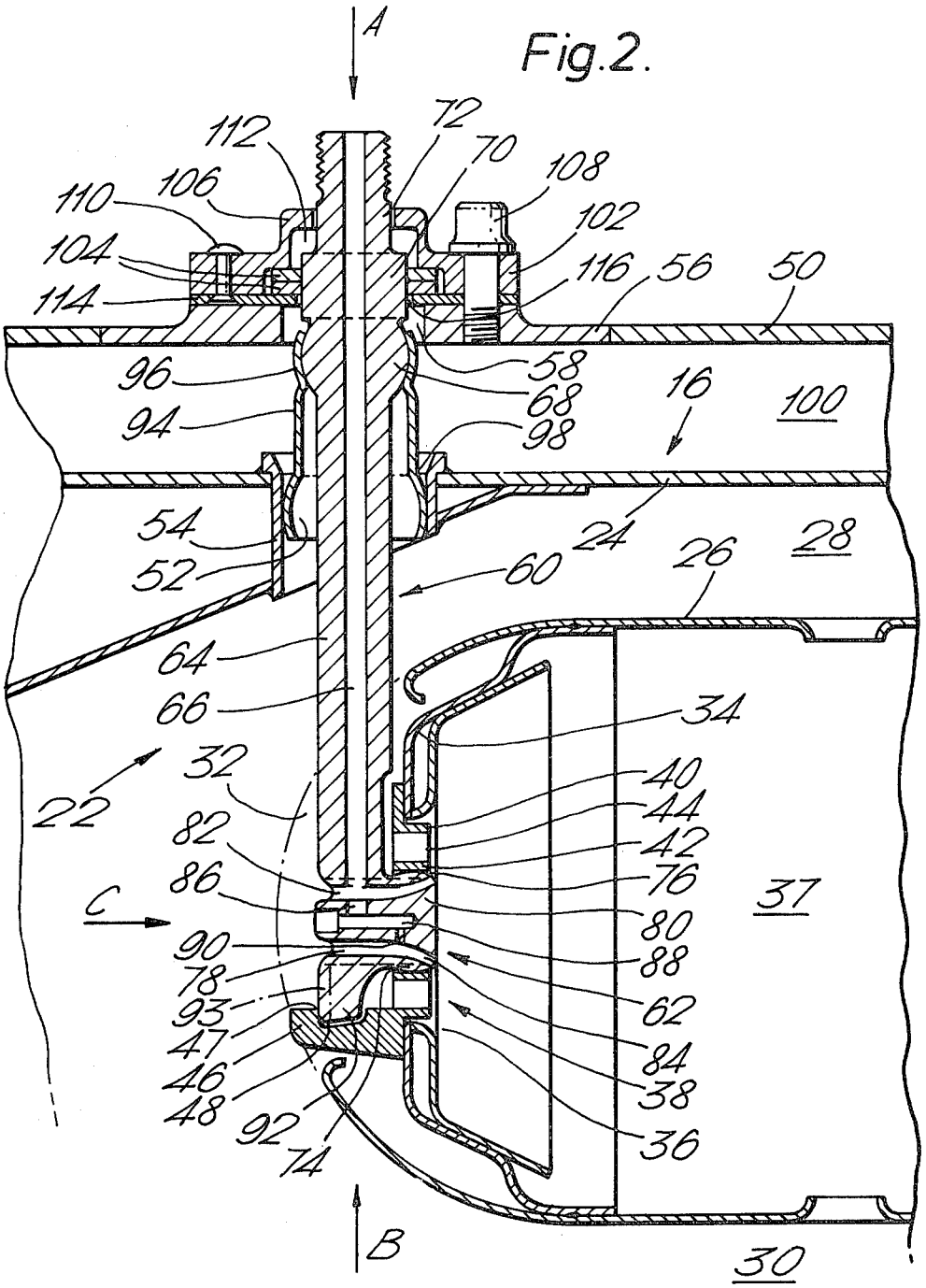
Figure 5:
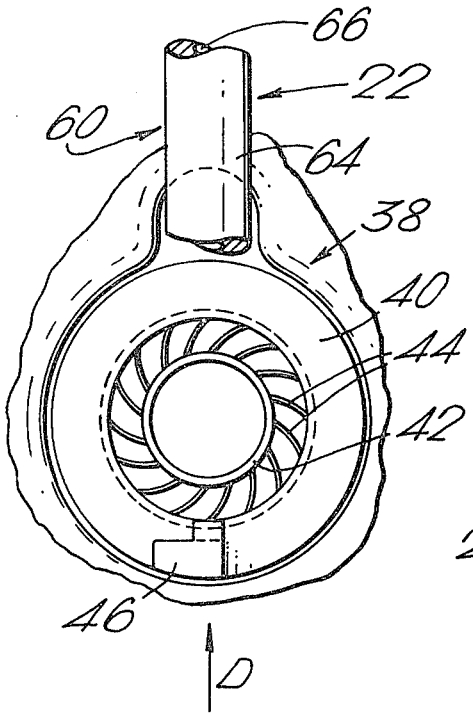
Figure 6:
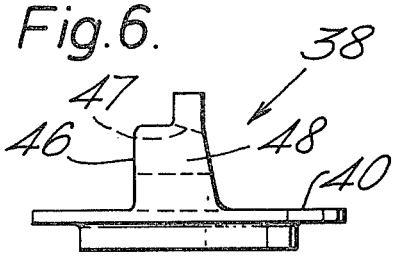

The present invention will be described with reference to the accompanying drawings in which;

FIG. 1 shows a cut-away view of a gas turbine engine having a fuel burner according to the present invention, FIG. 2 is a partial cross-sectional view of the fuel burner and the upstream end of the combustion equipment shown in FIG. 1, FIG. 3 is a view of the fuel burner in the direction of arrow A in FIG. 2, FIG. 4 is a partial view of the fuel burner in the direction of arrow B in FIG. 2, FIG. 5 is a partial view in the direction of arrow C in FIG. 2, and FIG. 6 is a partial view in the direction of arrow D in FIG. 5.

Figure 7:
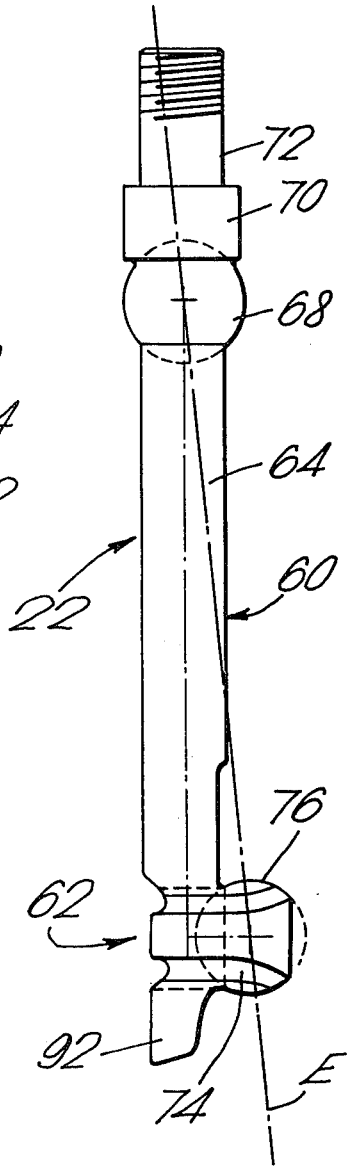

FIG. 7 shows the axis of rotation of the fuel burner.

FIG. 1 shows a cut-away view of a gas turbine engine 10, which comprises a fan 12, a compressor 14, annular combustion equipment 16, a turbine 18 and an exhaust nozzle 20. The annular combustion equipment 16 is fed with fuel from a number of fuel burners 22, FIG. 2 shows one of the fuel burners 22 and the upstream end of the annular combustion equipment 16. The annular combustion equipment 16 comprises an annular wall 24 and an annular flame tube 26, the annular wall 24 being spaced radially outboard from the annular flame tube 26. The annular flame tube 26 has annular air passages 28 and 30 positioned radially outboard and inboard respectively of the annular flame tube 26. The annular combustion equipment 16 is enclosed by an engine casing 50. The annular flame tube 26 has a number of equi-spaced apertures 32 in its upstream end, and an annular head 34. The head 34 has a number of apertures 36, each positioned downstream from an aperture 32 in the upstream end of the annular flame tube 26. The angular flame tube 26 has a primary zone 37 downstream from the head 34. A swirler assembly 38 is positioned coaxially in each aperture 36 in the head 34, and is attached to the upstream face of the head 34. The swirler assembly 38 comprises an outer cylindrical wall 40 and an inner cylindrical wall 42 with a plurality of swirl vanes 44 extending therebetween.

The swirler assembly 38 also has an upstream extending projection 46 which has a face 47 and a recess 48.

The annular wall 24 has a circumferential arrangement of equi-spaced holes 52, and a tubular duct 54 is positioned coaxially in each hole 52. The duct 54 extends radially inboard towards the upstream end of the annular flange tube 26. The engine casing 50 has a circumferential arrangement of bosses 56, and each boss 56 has a hole 58. Each hole 58 in a boss 56 is coaxial with a corresponding hole 52 in the annular wall 24.

The fuel burner 22 comprises a fuel feed arm 60 and a fuel injector 62. The fuel feed arm 60 comprises a cylindrical body 64, a partially spherical portion 68, and a cylindrical body 70. The fuel feed arm 60 has parallel faces 72 at the outboard end outwardly of the cylindrical body 70. The cylindrical body 64, the partially spherical portion 68 and the cylindrical body 70 are coaxial and are joined in end-to-end relationship. A fuel passage 66 extends coaxially through the cylindrical body 64, the partially spherical portion 68 and the cylindrical body 70, and supplies fuel to the fuel injector 62.

The fuel injector 62 is attached to the cylindrical body 64, and comprises a cylindrical body 74 which has a partially spherical outer surface 76. The axis of the cylindrical body 74 is normal to the axis of the fuel feed arm 60. A duct 78 passes coaxially through the cylindrical body 74, and a pintle 80 is positioned coaxially in the duct 78 to form an annular air passage 84. The pintle 80 is positioned coaxially in the duct 78 on an arm 82, and a fuel passage 86 in the arm 82 and the pintle 80 supplies fuel from the fuel passage 66 in the fuel feed arm 60 to a fuel chamber 88 in the pintle 80. A number of fuel passages 90 extend from the fuel chamber 80 to the annular air passage 84.

A tongue 92 has a face 93, and the tongue 92 extends normally from the cylindrical body 74 and parallel to the axis of the fuel feed arm 60.

A fuel burner 22 extends coaxially through each hole 58 in the boss 56 of the engine casing 50 and each hole 52 in the annular wall 24 and into the aperture 32 in the annular flame tube 26. The cylindrical body 74 of each fuel injector 62 is positioned in an aperture 36 in the head 34, and is positioned inside and coaxial with the cylindrical wall 42 of the swirler assembly 38, and the partially spherical outer surface 76 of the cylindrical body 74 abuts the cylindrical wall 42. The tongue 92 extends from the cylindrical body 74 and engages with the recess 48 in the upstream extending projection 46 of the swirler assembly 38, and face 93 of the tongue 92 contacts face 47 of the upstream extending projection 46. The axis of the fuel injector 62 is located coaxially with the axis of the aperture 36 and the axis of the swirler assembly 38 by the contact of the faces 47 and 93 of the upstream extending projection 46 and tongue 92 respectively.

A tube 94 with partially spherical ends 96 and 98 is positioned coaxially in and extends in an outboard direction from the hole 52. The tube 94 is also coaxial with and spaced from the fuel feed arm 60. The partially spherical ends 96 and 98 of each tube 94 engage with the partially spherical surface 68 of each fuel feed arm 60 and each tubular duct 54 respectively to form a seal between lower pressure air in the annular air space 100, formed between the engine casing 50 and the annular wall 24, and combustion air in the annular air passage 28.

A plate 114 which has a central hole 116 is secured to a retaining plate 102 by a number of rivets 110, and a number of piston rings 104 are positioned between the plates 114 and 102.

The retaining plate 102 has a central hole 112 and parallel faces 106. The plate 114, the piston rings 104 and the retaining plate 102 are secured to the boss 56 by a number of bolts 108.

The central holes 116 and 112 of the plate 114 and the retaining plate 102 respectively and the piston rings 104, are coaxial with the hole 58 in the boss 56 and the fuel feed arm 60. The piston rings 104 abut the cylindrical body 70 of the fuel feed arm 60 and form a seal between the annular air space 100 and the atmosphere, and the parallel faces 106 of the retaining plate 102 abut the parallel faces 72 of the fuel feed arm 60.

Each fuel burner 22 is inserted radially through the corresponding holes 52 and 58 in the annular wall 24 and the boss 56 in the engine casing 50 respectively, the partially spherical outer surface 76 of each fuel injector 62 is spigotted into the inner cylindrical wall 42 of the swirler assembly 38. The fuel burner 22 is then rotated (as shown in FIG. 7) about an axis E passing through the centre of a sphere of which the partially spherical outer surface 76 of the fuel injector 62 is a portion, and the centre of a sphere of which the partially spherical surface 68 of the fuel feed arm 60 is a portion so that the axes of the swirler assembly 38 and the fuel injector 62 are coaxial, this is achieved when the face 93 of the tongue 92 extending from the cylindrical body 74 abuts the face 47 of the upstream extending projection 46.

The plate 114, the piston rings 104 and the retaining plate 102 are then placed over the fuel burner 22 and are secured to the boss 56 by the bolts 108.

The parallel faces 106 of the retaining plate 102 engage with the parallel faces 72 of the fuel feed arm 60 to prevent the fuel feed arm 60 from rotating, and ensures that the faces 47 and 93 of the upstream extending projection 46 and the tongue 92 respectively remain in contact with each other, and that the fuel injector 62 remains located coaxially with the aperture 36 in the head 34.

In operation, referring to FIGS. 2, 3, 4, 5 and 6, air is supplied by the compressor 14 to the annular combustion equipment 16.

Part of the air supplied to the annular combustion equipment 16, called cooling air and secondary air flows into annular air passages 28 and 30, the cooling air is used to cool the annular flame tube 26 and the secondary air is used to complete the combustion of fuel in the annular flame tube 26. The remainder of the air, called primary air, enters the annular flame tube 26 through a number of equi-spaced apertures 32 in the upstream end of the annular flame tube 26.

A portion of the primary air flows through the swirler assembly 38 and is given a swirling motion by the swirl vanes 44 before the primary air enters the primary zone 37. The remainder of the primary air flows into the annular air passage 78 formed between the pintle 80 and the cylindrical body 74 of the fuel injector 62. Fuel is injected into the annular air passage 78 from a number of fuel passages 90 in the pintle 80. The fuel and primary air mixture then flows into the primary zone 37 and mixes with the swirling primary air entering the primary zone 37 from the swirler assembly 38. The fuel and primary air mixture is ignited by an igniter (not shown) and burnt, combustion is completed by addition of secondary air, through secondary air holes (not shown).

Fuel is supplied to the fuel burner 22 from a fuel supply (not shown), and the fuel flows through the fuel passage 66 in the fuel feed arm 60 to the fuel injector 62. The fuel flows from the fuel passage 66, through the fuel passage 86 in the arm 62 and pintle 80 of the fuel injector 62, into the fuel chamber 88 in the pintle 80. The fuel in the fuel chamber 88 is then injected into the annular air passage 78 through a number of fuel passages 90.

It will be appreciated that the use of a partially spherical outer surface 76 on the fuel injector 62 in conjunction with the tongue 92 and the upstream extending projection 46 enables the fuel burner 22 to be inserted and located accurately with respect to the axis of the aperture 36 in the head 34 with relative ease, by rotation of the fuel burner 22 about the axis E previously mentioned. The parallel faces 106 of the retaining plate 102 and the parallel faces 72 of the fuel feed arm 60 abut each other, and so ensure that the fuel burner 22 cannot rotate out of location, when the fuel burner 22 is in operation.

The axes of the fuel feed arm 60 and fuel injector 62 need not be perpendicular, they may make an obtuse angle at their bisections, or an acute angle.

The use of fuel burners with a cylindrical fuel feed arm and a fuel injector secured thereto enables the access holes to be of substantially smaller diameter.

Although the invention has been described with reference to annular flame tubes it could equally well be adapted for use in can annular or tubular flame tubes.

The invention may not be limited to the use of the fuel injector shown, fuel burners with other types of fuel injector may be used providing the fuel injector has a cylindrical body with a duct passing coaxially through the cylindrical body, i.e. it may be of the air-atomising type.

The invention may be applied to combustion equipment that does not comprise an annular wall 24.

I claim:

1. Combustion equipment for a gas turbine engine having an engine casing with at least one hole therethrough, said combustion equipment being positioned within said engine casing and comprising:

at least one flame tube having a head at an upstream end thereof, said head having at least one aperture therein;

an annular swirler assembly positioned coaxially in said at least one aperture in the head of said flame tube;

a fuel burner capable of being installed as a unit through said at least one hole in said engine casing and accurately positioned in said swirler assembly, said fuel burner including a fuel feed arm and a fuel injector joined together as a unit, said fuel feed arm and said fuel injector each being cylindrical for a major portion of their length and having axes at an angle to each other, said fuel feed arm having at least one fuel passage and said fuel injector having an air duct therethrough coaxial with an axis of the fuel injector and having at least one fuel passage communicating with said fuel feed arm passage for injecting fuel into said air duct; and locating means for accurately positioning said fuel injector in said swirler assembly when said fuel burner is installed as a unit through said at least one hole in said casing, said locating means including an upstream extending projection attached to said swirler assembly and having a recess and a face, said fuel injector having a tongue attached thereto and extending in a direction normal to the axis of the fuel injector, said tongue having a face thereon for abutting the face on said projection when said fuel injector is accurately positioned in said swirler assembly, said fuel injector having a partially spherical outer surface on a downstream end thereof which is positioned in said annular swirler assembly whereby when said fuel burner is inserted as a unit through said hole in said engine casing and the partially spherical outer surface of said fuel injector is inserted into the annular swirler assembly, the fuel burner can be rotated about an axis passing through a center of a sphere of which the partially spherical outer surface of the fuel injector forms a part to cause the tongue on the fuel injector to engage in said recess in the upstream extending projection so that the faces of said tongue and the upstream extending projection abut each other to accurately position the fuel injector coaxially in the annular swirler assembly.

2. Combustion equipment as claimed in claim 1 in which said axes of said fuel feed arm and said fuel injector are normal to each other and in which said tongue extends in a direction parallel to an axis of said fuel feed arm.

3. Combustion equipment as claimed in claim 2 including means to retain said fuel injector coaxially in said annular swirler assembly after said fuel injector has been accurately positioned, said retaining means comprising a retaining plate having a central hole and parallel faces, said retaining plate being secured to said engine casing and said central hole of said retaining plate being coaxial with said at least one hole in said engine casing, said fuel feed arm having parallel faces on an end remote from said fuel injector engaging said parallel faces of said central hole of said retaining plate and ensuring said fuel burner against rotation about said axis of rotation passing through the center of a sphere of which the partially spherical outer surface of said fuel injector forms a part so that said tongue remains engaged in said recess.

4. Combustion equipment as claimed in claim 3 in which said at least one hole in said engine casing is a plurality of circumferentially spaced holes and in which said at least one aperture in said head of said at least one flame tube is a plurality of apertures corresponding in number to said holes in said engine casing and in which a plurality of annular swirler assemblies are provided, one of said swirler assemblies being positioned in each of said apertures, and in which a plurality of fuel burners are provided, one of said fuel burners for each of said holes in said casing and a corresponding one of said swirler assemblies and said combustion equipment further including an annular wall positioned radially between said engine casing and said at least one flame tube, said annular wall having a plurality of circumferentially spaced holes, each of said plurality of holes in said annular wall being coaxial with a corresponding one of said plurality of spaced circumferentially spaced holes in said engine casing, a plurality of tubes with partially spherical ends, said plurality of tubes each having one of said partially spherical ends in one of said holes and abutting said annular wall and extending therefrom in an outboard direction, each of said tubes being positioned around a corresponding one of said fuel feed arms, said fuel feed arms each having a partially spherical surface abutting the respective partially spherical end of a respective tube to restrict flow of air radially through said annular wall.

5. Combustion equipment as claimed in claim 4 in which the combustion equipment comprises an annular flame tube, a can annular flame tube or a plurality of tubular flame tubes.

* * * * *